US006522253B1

(12) United States Patent
Saltus

(10) Patent No.: US 6,522,253 B1
(45) Date of Patent: Feb. 18, 2003

(54) LUGGAGE LOCKING AND LOCATING DEVICE

(76) Inventor: Kermit Anthony Saltus, 19 Adler Pl. suite B, Bronx, NY (US) 10475-3904

( * ) Notice: Subject to any disclaimer, the term of this patent is extended or adjusted under 35 U.S.C. 154(b) by 114 days.

(21) Appl. No.: 09/628,770

(22) Filed: Jul. 31, 2000

(51) Int. Cl.[7] ..... G08B 13/14

(52) U.S. Cl. ..... 340/571; 340/568.1; 340/539; 340/693.5; 340/691.5

(58) Field of Search ..... 340/571, 568.1, 340/568.6, 572.1, 539, 825.49, 693.5, 815.45, 691.5, 691.4, 825.36

(56) References Cited

U.S. PATENT DOCUMENTS 5,278,556 A * 1/1994 Oh ..... 340/321
6,113,455 A * 9/2000 Whelan et al. ..... 248/214
6,147,602 A * 11/2000 Bender ..... 340/539

* cited by examiner

*Primary Examiner*—Daniel J. Wu
*Assistant Examiner*—Sihong Huang
(74) *Attorney, Agent, or Firm*—Michael I. Kroll

(57) ABSTRACT

A locating device for aiding a user in finding an object. The locating device includes a remote unit and a tag unit. The remote unit is retained by the user and includes a first processor for generating an alarm activation signal; a transmitter for transmitting the alarm activation signal; a sound alarm button and a light alarm button. The sound and light alarm buttons are manually activated for controlling the processor to generate the alarm activation signal. The tag unit is releasably secured to the object and includes a tag section and a locking section. The tag section includes identification information concerning the user and a cover for providing selective access to the information. The locking section includes a lock for releasably securing the tag unit to the object; a second processor; an alarm signal generator; and a receiver for receiving the alarm activation signal and activating the alarm generator to generate at least one of a visual and audible alarm signal. The visual and audible alarm signals may be identified at a distance of at least 30 feet from the tag unit. The audible signal may be a melodic tune readily recognized by the user.

5 Claims, 9 Drawing Sheets

LUGGAGE LOCKING AND LOCATING DEVICE

BACKGROUND OF THE INVENTION

1. Field of the Invention

The present invention relates generally to luggage and, more specifically, to a device able to generate an audible and visible signal to thereby assist the owner in locating the piece of luggage in a crowded area.

2. Description of the Prior Art

Numerous types of luggage locating devices have been provided in the prior art. For example, U.S. Pat. Nos. 5,214,410, 5,650,768 and 5,781,109 all are illustrative of such prior art. While these units may be suitable for the particular purpose to which they address, they would not be as suitable for the purposes of the present invention as heretofore described.

U.S. Pat. No. 5,214,410

Inventor: Theunis C. Verster

Issued: May 25, 1993

A locating system for locating a predetermined labeled objects includes a transceiver unit which comprises a narrow beamwidth antenna for transmitting an energizing signal at a predetermined first frequency and for receiving a return signal at a predetermined second frequency from an object to be located, the energizing signal incorporating a predetermined transponder category code. A plurality of label-like transponders is provided, each of which is affixable to an object to be located. Each transponder includes logic circuitry in order that each transponder in a predetermined group of labeled objects constituting the category radiates a returned signal, including a transponder identification code, to the transceiver unit in a time-delayed manner so that returned signals are received serially by the transceiver unit.

U.S. Pat. No. 5,650,768

Inventor: Kapali P. Eswaran

Issued: Jul. 22, 1997

An automatic baggage claiming apparatus for use in an airport, train station or bus station controls removal of baggage from a secured area. The present invention scans a baggage tag and a claim check in order to obtain the baggage tag identifier and the claim check identifier, respectively. The present invention compares the tag identifiers and provides a signal if the tag identifiers are the same or an alert signal if the tag identifiers are not the same. If the signal is provided, a passenger is permitted to exit the secured area with the checked baggage. However, if the alert signal is provided, the passenger is prevented from exiting the secured area with the baggage.

U.S. Pat. No. 5,781,109

Inventor: Shozo Nakajima

Issued: Jul. 14, 1998

An alarm system for preventing loss of personal property comprises a pair of radio signal transmission/alarm units that each include a sending component having a signal oscillator and a receiving/alarm component comprising a tuner for selecting a signal from the sending component and receiving the signal as an electrical current, and amplifier for amplifying the signal current, an alarm and a switch that switches off the alarm when the amplified signal current is above a prescribed level and switches on the alarm when the amplified signal current does not exceed a prescribed level. The signal transmitted by one sending component is tuned to the receiving/alarm component tuner frequency of the other transmission/alarm unit, and each receiving/alarm component is tuned to the signal frequency of the sending component in the other transmission/alarm unit.

U.S. Pat. No. 5,613,574

Inventor: Charles J. Melanson

Issued: Mar. 25, 1997

A combined compartmented tray and tool holster is arranged to removably clamp onto the top step of a stepladder. The tool holster presents the tool to one side of the ladder or the other as desired. An opening at the bottom of the holster permits passage therethrough of the end of the tool with any tool bit attached thereto. The tool handle rests securely in ready reach of the worker without fear of dropping the tool, while both hands are free when required. Items in the compartments are also within case reach and view of the worker. The clamping system for clamping the device to the top step is adjustable to steps of various thicknesses.

SUMMARY OF THE PRESENT INVENTION

The present invention relates generally to luggage and, more specifically, to a device able to generate an audible and visible signal to thereby assist the owner in locating the piece of luggage in a crowded area.

A primary object of the present invention is to provide a luggage locking and locating device that will overcome the shortcomings of prior art devices.

Another object of the present invention is to provide a luggage locking and locating device which is able to aid a person in locating an object such as luggage in a crowded area, provide an audio indication signal for sight impaired users and provide a visual indication signal for hearing impaired users.

A further object of the present invention is to provide a luggage locking and locating device which is able to minimize the possibility of having luggage stolen or taken by a person other than the owner.

A yet further object of the present invention is to provide a luggage locking and locating device including a remotely activated audible alarm and visual alarm to signal the owner as to the location of the object.

An even further object of the present invention is to provide a luggage locking and locating device including a remote control unit for remotely activating the audible and visual alarms.

A still further object of the present invention is to provide a luggage locking and locating device including a user friendly device for locking the object to which the device is attached.

A yet further object of the present invention is to provide a luggage locking and locating device having a tag for placement of information about the owner such as name, address and telephone number to aid in identifying the owner of the object to which it is attached.

An even further object of the present invention is to provide a luggage locking and locating device wherein the visual signal is able to be viewed a minimum of thirty feet from the device.

A still further object of the present invention is to provide a luggage locking and locating device wherein the audible alarm, when activated, is able to be heard a minimum of thirty feet from the device.

Another object of the present invention is to provide a luggage locking and locating device wherein the audible alarm is melodical and can be readily recognized by the owner.

A yet further object of the present invention is to provide a luggage locking and locating device including logos as desired by the user to personalize the device.

Another object of the present invention is to provide a luggage locking and locating device that is simple and easy to use.

A still further object of the present invention is to provide a luggage locking and locating device that is economical in cost to manufacture.

Additional objects of the present invention will appear as the description proceeds.

A locating device for aiding a user in finding an object is disclosed by the present invention. The locating device includes a remote unit and a tag unit. The remote unit is retained by the user and includes a first processor for generating an alarm activation signal; a transmitter for transmitting the alarm activation signal; a sound alarm button and a light alarm button. The sound and light alarm buttons are manually activated for controlling the processor to generate the alarm activation signal. The tag unit is releasably secured to the object and includes a tag section and a locking section. The tag section includes identification information concerning the user and a cover for providing selective access to the information. The locking section includes a lock for releasably securing the tag unit to the object; a second processor; an alarm signal generator; and a receiver for receiving the alarm activation signal and activating the alarm generator to generate at least one of a visual and audible alarm signal. The visual and audible alarm signals may be identified at a distance of at least 30 feet from the tag unit. The audible signal may be a melodic tune readily recognized by the user.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
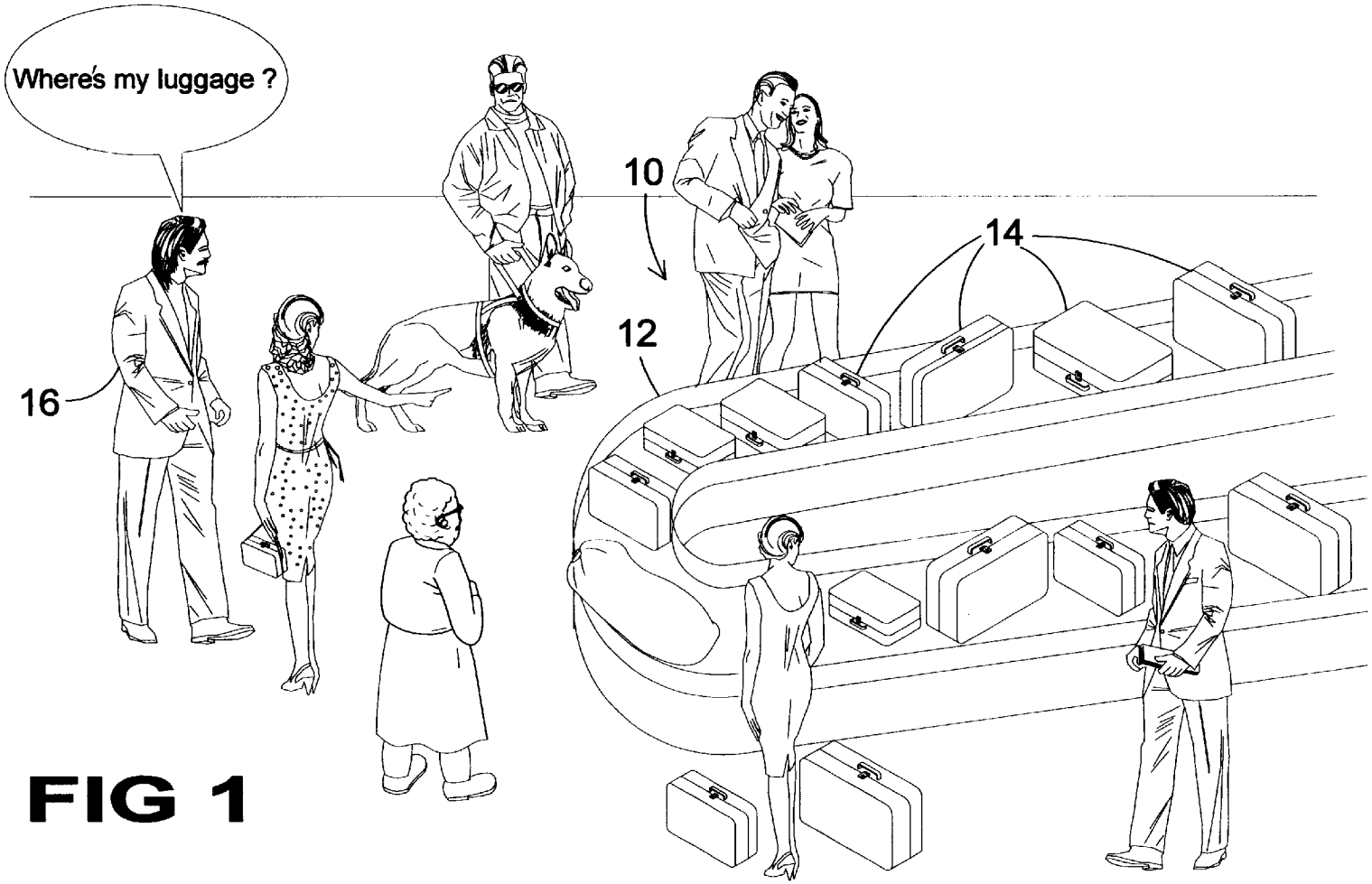
FIG. 1 is a perspective view of a person attempting to locate a piece of luggage in a crowded airport.

Turning now descriptively to the drawings, in which similar reference characters denote similar elements throughout the several views, the Figures illustrate the luggage locking and locating device of the present invention. With regard to the reference numerals used, the following numbering is used throughout the various drawing figures.

10 luggage pickup area
12 luggage carousel
14 luggage on carousel
16 person searching for luggage
18 luggage locking and locating device of the present invention
20 tag unit of luggage locking and locating device attached to a piece of luggage
22 remote control unit of luggage locking and locating device
24 owner of piece of luggage
26 lines indicative of visual alarm
28 arced lines indicative of audible alarm
30 arced lines indicative of transmitted activation signal
32 housing of tag unit
34 speaker of audible alarm
36 light of visual alarm
38 locking device
40 combination lock for unlocking locking device
42 antenna of remote unit
44 activation button for audible alarm
46 activation button for visual alarm
48 label of tag unit
50 processor of tag unit
52 power source of tag unit
54 receiver of tag unit
56 audible alarm generator of tag unit
58 visual alarm generator of tag unit
60 processor of remote unit
62 power source of remote unit
64 transmitter of remote unit
66 lock section of tag unit
68 tag section of tag unit
70 cover for label of tag section

72 information section of tag section

74 securing device for cover

DETAILED DESCRIPTION OF THE PREFERRED EMBODIMENT

FIG. 1 illustrates a crowded luggage area 10 in a location such as an airport. Within the luggage area 10 is a luggage carousel 12 on which luggage 14 it transported for pickup by travelers 16. As numerous travelers 16 clamor around the luggage carousel 12 in attempts to retrieve their luggage 14, the task of locating an individual piece of luggage 14 is difficult. Additionally, numerous pieces of luggage 14 may have a similar or even identical appearance thereby further increasing the difficulty of locating a particular piece of luggage 14. As can be seen from FIG. 1, a typical traveler 16 is searching for his luggage 14. This traveler 14 is not having much success due to the number of other travelers also searching for luggage 14 and the similar appearance of many of the pieces of luggage 14 traveling along the luggage carousel 12.

Turning now descriptively to the drawings, in which similar reference characters denote similar elements throughout the several views, FIGS. 2 through 7 illustrate the luggage locking and locating device of the present invention indicated generally by the numeral 18. The luggage locking and locating device 18 may be used to locate a piece of luggage or any other desired object to which the device is connected as described below. The luggage locking and locating device 18 is useful for locating objects in any area such as airline terminals, passenger ship terminals and other similar environments. The luggage locking and locating device 18 may also be used to locate a misplaced object to which the device is attached.

Figure 2:
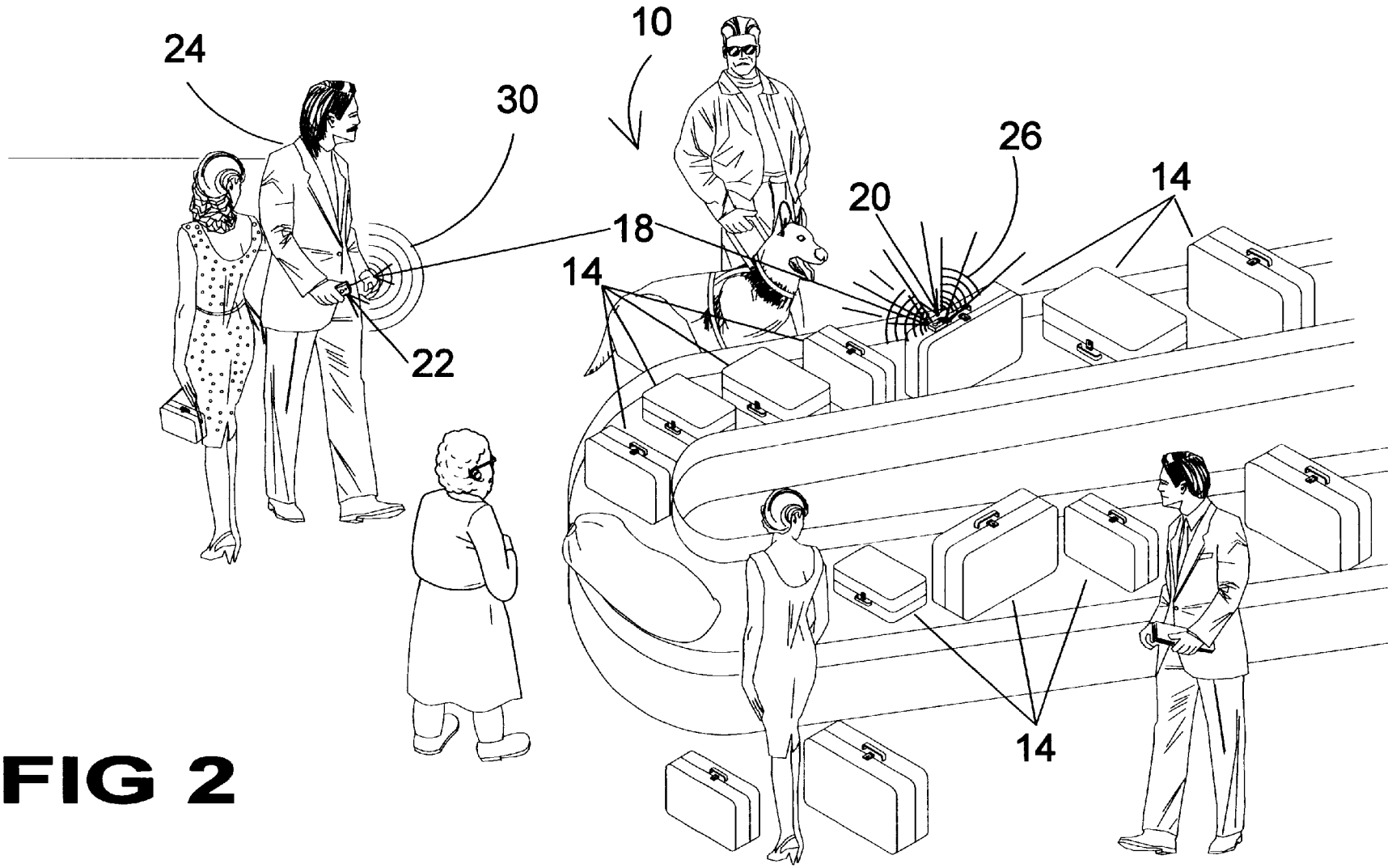
FIG. 2 is a perspective view of a person using the luggage locking and locating device of the present invention to locate a piece of luggage in a crowded airport.

The luggage locking and locating device 18 is shown in FIG. 2 attached to a piece of luggage 14. The luggage locking and locating device 18 includes a tag unit 20 releasably attached to the piece of luggage 14 and a remote unit 22 retained by the user 24 of the luggage 14. The tag unit 20 of the luggage locking and locating device 18 generates both a visual alarm signal and an audible alarm signal upon receipt of an activation signal from the remote unit 22. The visual alarm signal is indicated by the diagonal lines shown emanating from the tag unit 20 and labeled with the numeral 26. The audible alarm signal is indicated by the arced lines shown emanating from the tag unit 20 and labeled with the numeral 28. The activation signal is transmitted by the remote unit 22 and is indicated by the arced lines labeled with the numeral 30 emanating from the remote unit 22. The user 24 must activate the remote unit 22 to transmit the activation signal 30 for receipt by the tag unit 20. Upon receipt of the activation signal 30 the tag unit 20 will generate either or both the visual and audible alarm signals. The visual and audible alarm signals aid the user 24 in locating a piece of luggage 14.

Figure 2A:
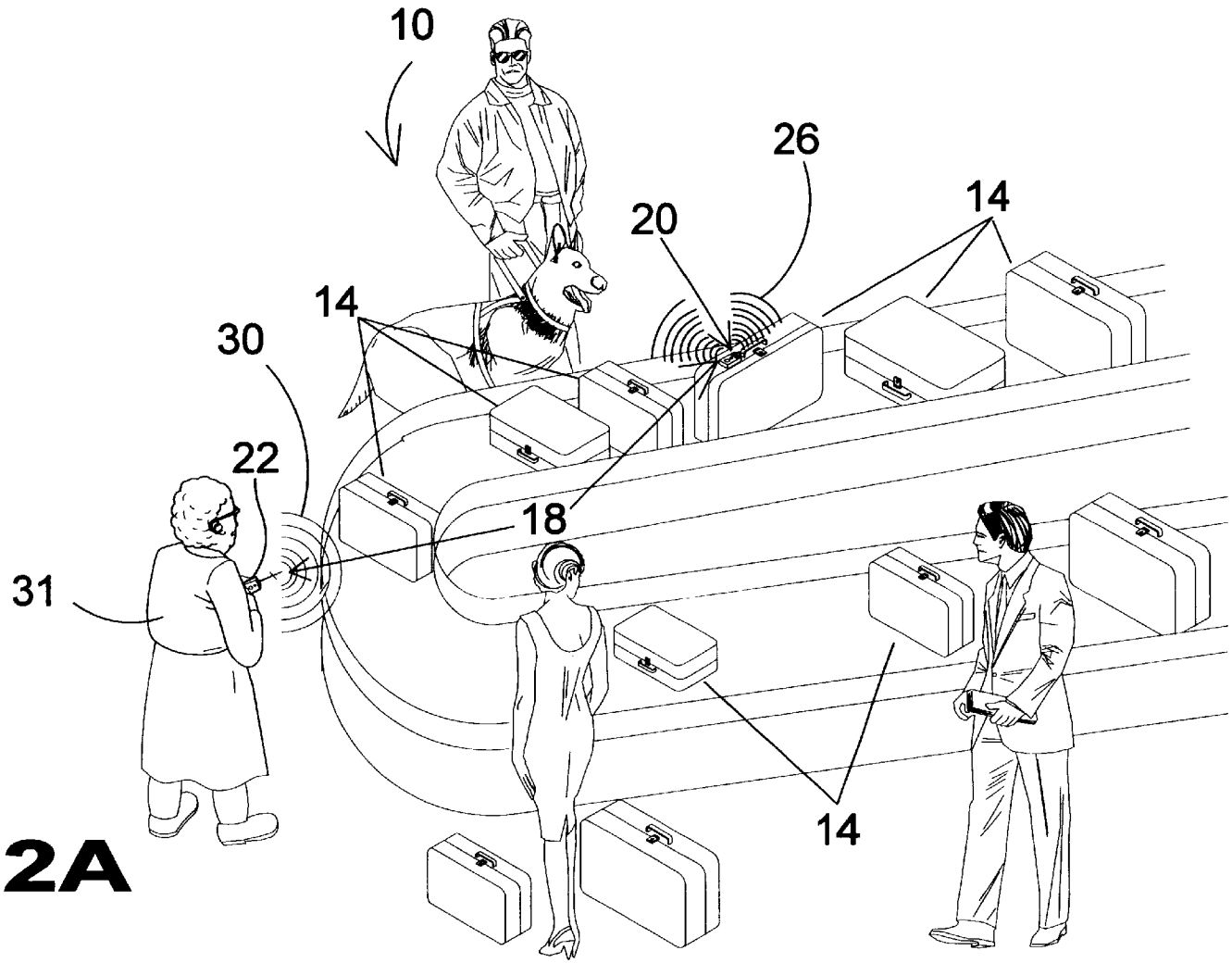
FIG. 2A is a perspective view of a hearing impaired person attempting to locate a piece of luggage in a crowded airport.

The audible alarm signal is also helpful in aiding a hearing impaired person 31 to locate a piece of luggage 14 as illustrated in FIG. 2A. This figure illustrates the hearing impaired person 31 activating the remote unit 22 to transmit an activation signal 30 indicating the audible signal should be activated. Upon receipt of the activation signal 30, the audible signal 26 will be generated. The hearing impaired person 31 then listens for the distinct tone of the audible alarm signal. The hearing impaired person 31 is then able to follow the sound of the audible alarm signal 26 to the location of the piece of luggage 14. The audible alarm signal 26 is preferably able to be heard within a range of at least 30 feet from the tag unit 20. The audible alarm signal 26 may also produce a melodical tune which can be readily recognized by the owner of the object. The melodical tune may be any tune the owner desires and can recognize.

Figure 2B:
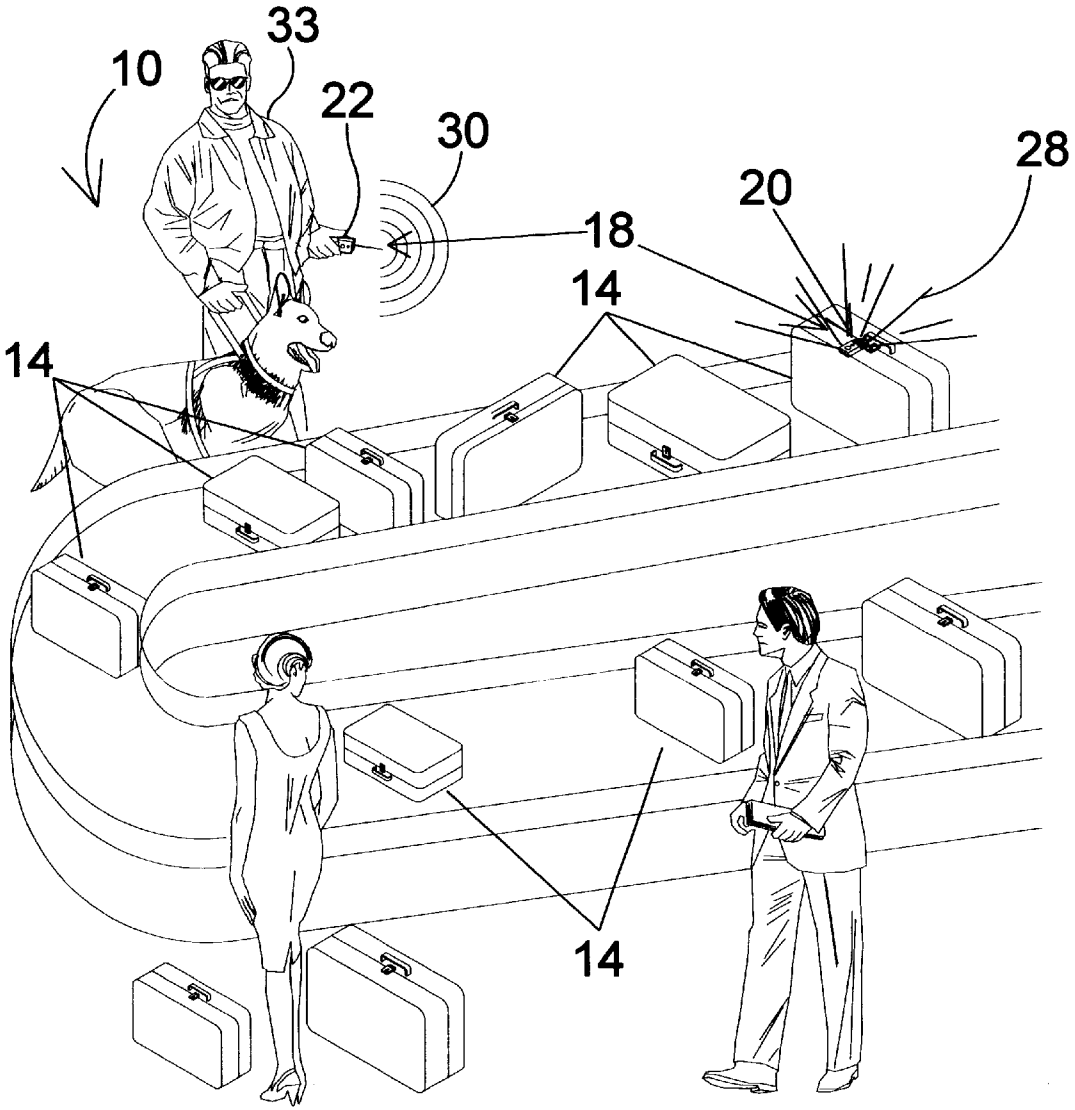
FIG. 2B is a perspective view of a sight impaired person attempting to locate a piece of luggage in a crowded airport.

The visual alarm signal is helpful in aiding a sight impaired person 33 to locate a piece of luggage 14 as illustrated in FIG. 2B. This figure illustrates the sight impaired person 33 activating the remote unit 22 to transmit an activation signal 30 indicating the visual signal should be activated. Upon receipt of the activation signal 30, the visual signal 28 will be generated. The sight impaired person 33 then looks around the baggage area 10 for the distinct visual signal 28 or light emitted by the visual alarm signal. The sight impaired person 33 is then able to walk towards the light emitted by the visible alarm signal 28 to the location of the piece of luggage 14. The visual alarm signal 28 is preferably able to be seen from within a range of at least 30 feet from the tag unit 20.

Figure 3:
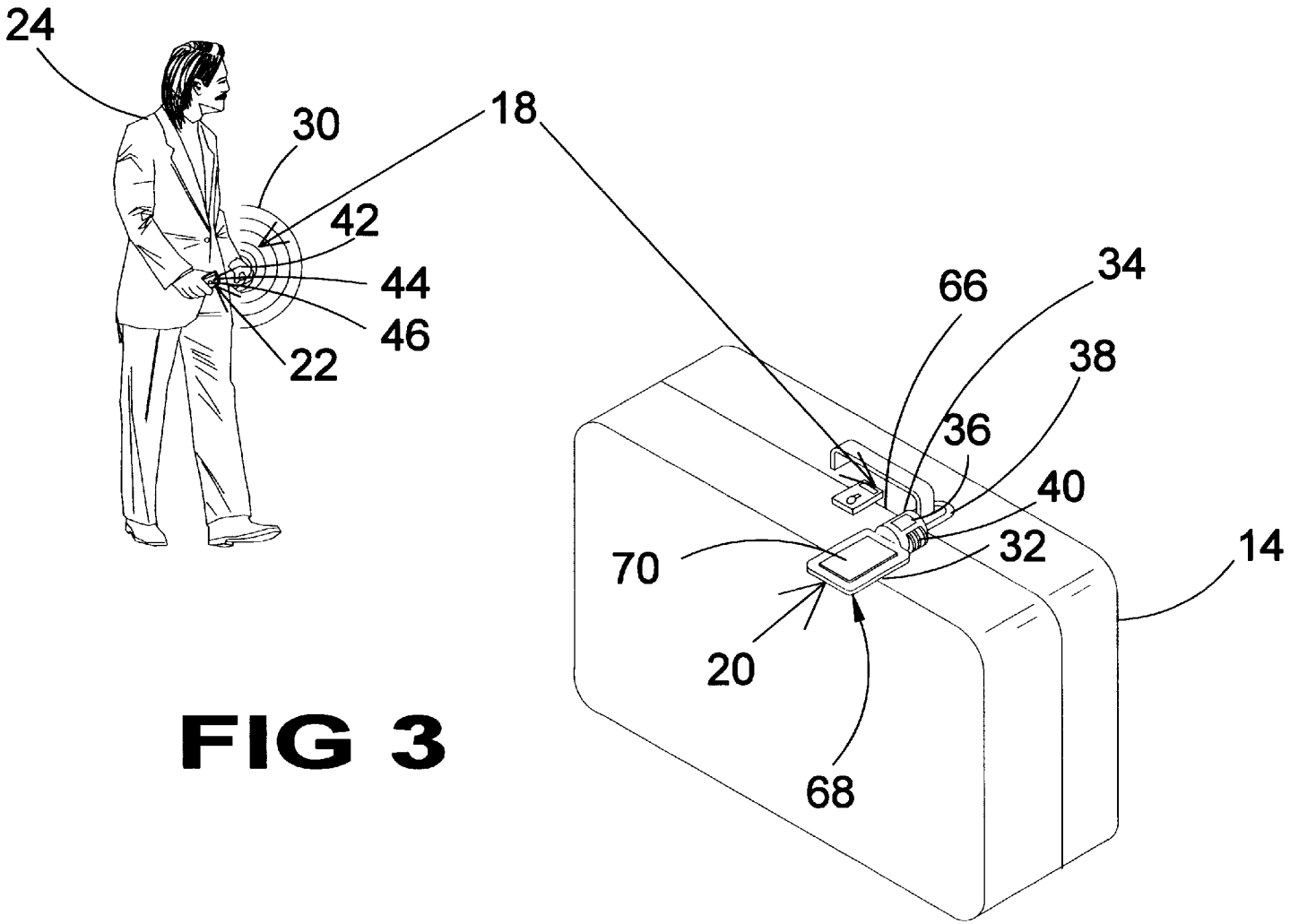
FIG. 3 is a top perspective view of the luggage locking and locating device of the present invention attached to a piece of luggage and the owner holding the remote control.

An enlarged picture of the person 24 using the luggage locking and locating device 18 of the present invention is illustrated in FIG. 3. As can be seen from this figure, the person 24 is holding the remote unit 22. The tag unit 20 is attached to the piece of luggage 14. The tag unit 20 includes a locking section 66 and a tag section 68. The locking section 66 includes a speaker 34 through which the audible alarm is sounded and a light 36 for generating the visual alarm. A locking device 38 extends from the tag section 66 for selectively securing the tag unit 20 to a piece of luggage 14. A combination lock 40 is provided on the locking section 66 for locking the tag unit 20 to the piece of luggage 14. The use of a combination lock 40 is for purposes of example only. In use, any type of locking device able to releasably secure the tag unit 20 to an object may be used.

The tag section 68 extends from the locking section 66 on a side opposite the locking device 38 and retains identification information concerning the owner 24 of the piece of luggage 14. The tag section 68 includes an information section 72 as is clearly seen in FIG. 4 and a cover 70 for providing selective access to the information on the information section 72. The tag section 68 extends so it may be easily grasped and viewed by a person adjacent the piece of luggage 14 to which it is attached. The cover 70 includes a securing device 74 for selectively restricting access to the information section 72.

The remote unit 22 is retained by the owner 24 of the piece of luggage 14. The remote unit 22 includes a light activation button 44 and a sound activation button 46 as is clearly seen in FIG. 5. When the owner 24 presses the light activation button 44, an activation signal 30 is generated and transmitted by the remote unit 22 indicating the light activation button 44 has been pressed. When the owner 24 presses the sound activation button 46, an activation signal 30 is generated and transmitted by the remote unit 22 indicating the sound activation button 46 has been pressed. The signals transmitted by the remote unit 22 are of a predetermined frequency able to be received by the tag unit 20. When the tag unit 20 receives a signal transmitted by the remote unit 22, the received signal is analyzed. If the tag unit 20 determines the signal indicates the light activation button 44 has been pressed, the tag unit 20 generates the visual alarm signal. If the tag unit 20 determines the signal indicates the sound activation button 46 has been pressed, the tag unit 20 generates the audible alarm signal. If the tag unit 20 determines the signal indicates both the light activation button 44 and sound activation button 46 have been pressed, the tag unit 20 generates both the visual alarm signal and the audible alarm signal. The activation signal being transmitted by the remote unit 22 is indicated by the arced lines labeled with the numeral 30.

Figure 4:
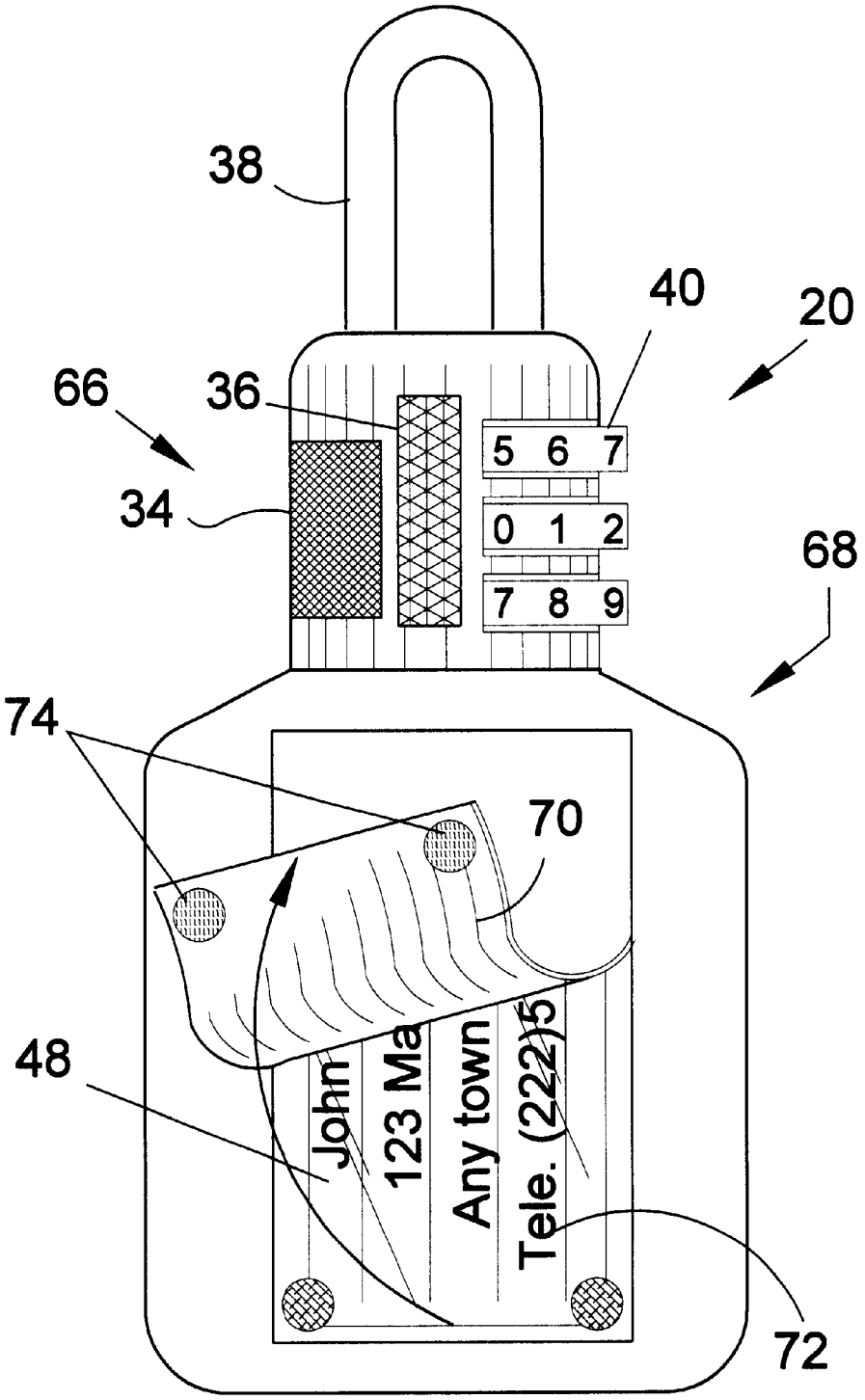
FIG. 4 is a top perspective view of the signaling tag of the luggage locking and locating device of the present invention.

An enlarged view of the tag unit 20 is illustrated in FIG. 4. As can be seen from this figure, tag unit 20 includes a locking section 66 and a tag section 68. The locking section 66 includes a speaker 34 through which the audible alarm is sounded and a light 36 for generating the visual alarm signal. A second light (not shown) may be provided on the opposite side of the tag section 66. Thus, the visual alarm signal is viewable from either side of the tag unit 20 and thereby allowing the visual alarm signal to be viewed regardless of the side on which the tag unit 20 is resting. The locking device 38 extends from the tag section 66 for selectively securing the tag unit 20 to a piece of luggage 14. A combination lock 40 is provided on the locking section 66 for locking the locking device 38 and thus the tag unit 20 to the piece of luggage 14.

The tag section 68 extends from the locking section 66 on a side opposite the locking device 38. The tag section is provided for retaining identification information concerning the owner of the piece of luggage 14 and includes an information section 72 and a cover 70. The cover provides selective access to the information 74 on the information section 72. A securing device 74 is provided on the cover 70 for restricting access to the information contained on the information section 72. The securing device 74 adds a further measure of confidentiality for the owner of the luggage 14. The tag section 68 extends from the locking section 66 such it may be easily grasped and viewed by a person adjacent the piece of luggage 14 to which it is attached. The person grasping the tag section 68 is thus able to readily determine the owner of the piece of luggage 14. The tag unit 20 may also include logos as desired by the user to personalize the device and further aid the user in identifying the object to which it is attached.

Figure 5:
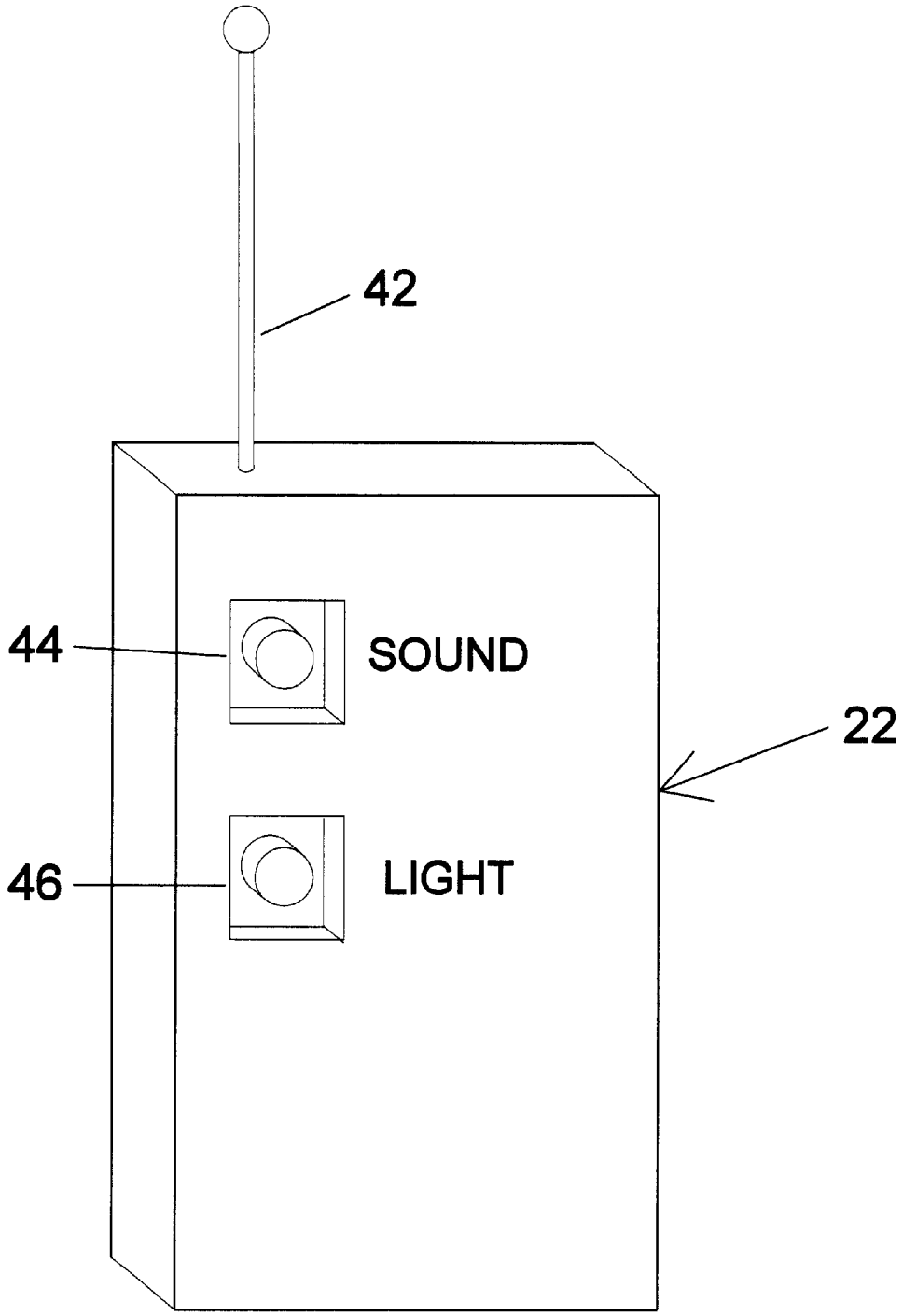
FIG. 5 is a top perspective view of the remote control unit of the luggage locking and locating device of the present invention.

An enlarged view of the remote unit 22 is illustrated in FIG. 5. The remote unit 22 is retained by the owner 24 of the piece of luggage 14 and includes a light activation button 44 and a sound activation button 46. When the owner 24 presses the light activation button 44, an activation signal is generated and transmitted by the remote unit 22 indicating the light activation button 44 has been pressed. When the owner 24 presses the sound activation button 46, a signal is generated and transmitted by the remote unit 22 indicating the sound activation button 46 has been pressed. An antenna 42 extends from the remote unit 22 for use in transmitting the sound alarm signal and the visual alarm signals to the tag unit 20. The signals transmitted by the remote unit 22 are of a predetermined frequency matched with the frequency of the tag unit 20. Thus, the tag unit is able to receive the activation signal 30.

Figure 6:
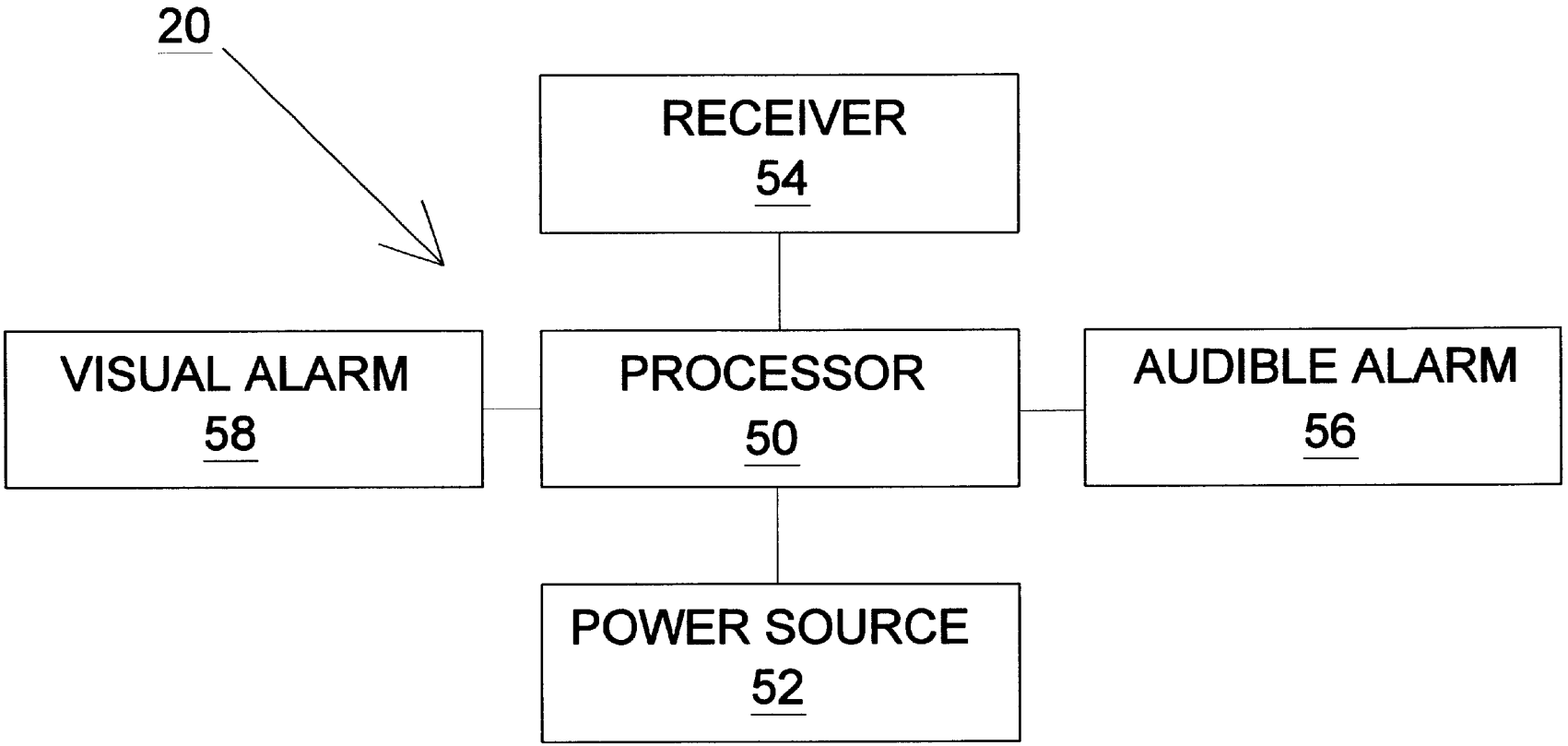
FIG. 6 is a block diagram of the luggage locking and locating device of the present invention.

A block diagram illustrating the components of the tag unit 20 is illustrated in FIG. 6. The tag unit 20 includes a processor 50. A power source 52 is connected to the processor 50 for supplying operating power thereto. The power source 52 is preferably in the form of an internal battery. However, any known power source may be used which is not obtrusive to the design and does not greatly increase the size of the tag unit 20 may be used. A receiver 54 is connected to the processor 50 for relaying received signals thereto. The receiver 54 is tuned to the transmission frequency of the remote unit 22 and thus is able to receive the activation signal 30 transmitted by the remote unit 22. An audible alarm generator 56 and a visual alarm generator 58 are connected to the processor 50. The audible alarm generator 56 is controlled by the processor 50 to generate the audible alarm signal 26 upon determining the received activation signal indicates that the user activated the sound alarm button 44 on the remote unit 22. The audible alarm generator 56 will produce the audible alarm signal 26 through the speaker 34. The visual alarm generator 58 is controlled by the processor 50 to generate the visual alarm signal 28 upon determining the received activation signal indicates that the user activated the visual alarm button 46 on the remote unit 22. The visual alarm generator 58 causes the lights on the locking section 66 of the tag unit 20 to become illuminated.

Figure 7:
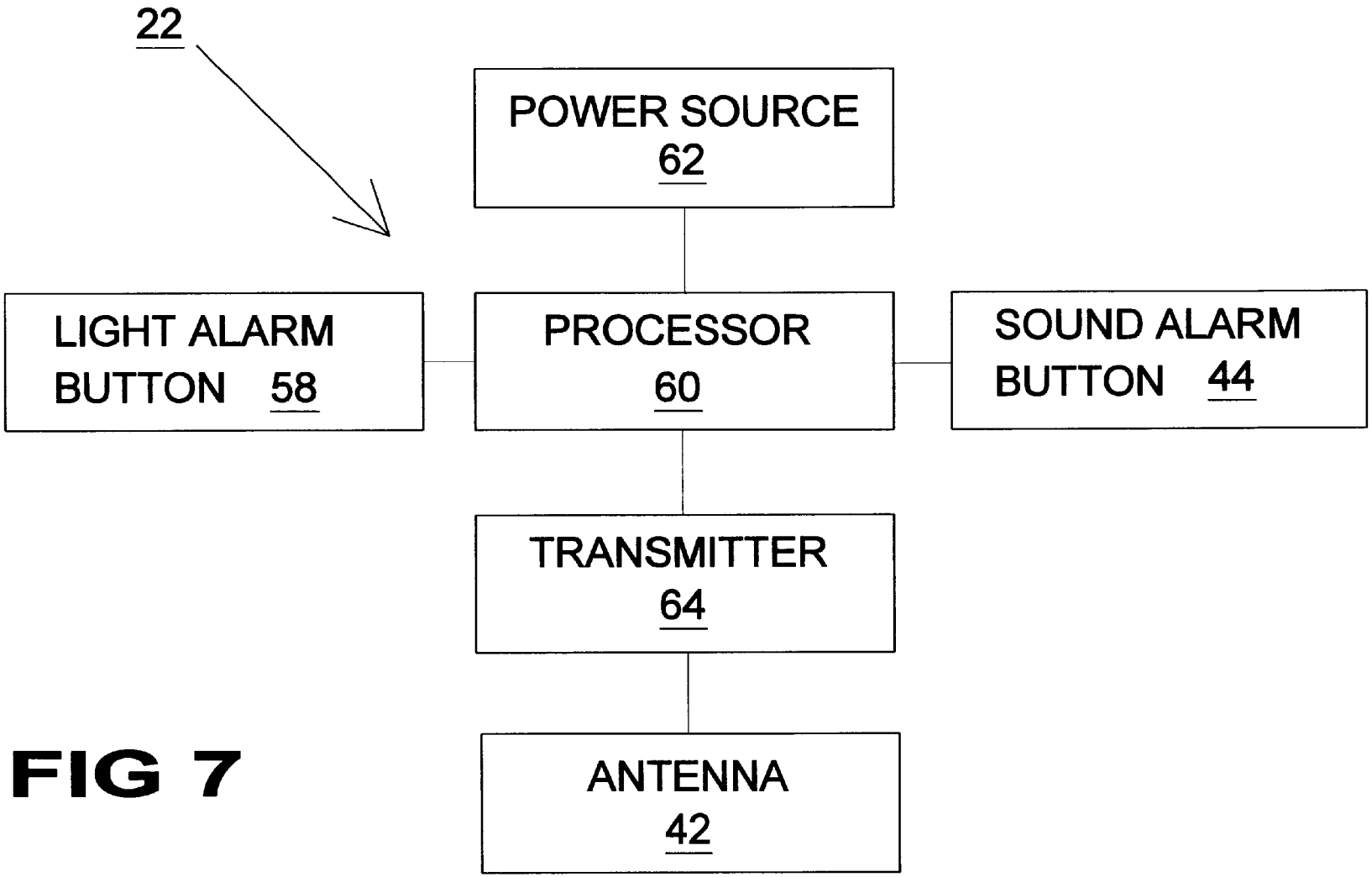
FIG. 7 is a block diagram of the remote control unit of the luggage locking and locating device of the present invention.

A block diagram illustrating the components of the remote unit 22 is illustrated in FIG. 7. The remote unit 22 includes a processor 60. A power source 62 is connected to the processor 60 for supplying operating power thereto. The power source 62 is preferably in the form of an internal battery. However, any known power source may be used which is not obtrusive to the design and does not greatly increase the size of the remote unit 22 thereby making carrying of the remote unit burdensome to the user may be used. The audible alarm button 44 and the light alarm button 46 are connected to the processor 60. Also connected to the processor 60 is a transmitter 64 and antenna 42. Upon activation of either or both the sound alarm button 44 and the light alarm button 46, the processor 60 generates an activation signal. The processor 60 then controls the transmitter 64 to transmit the activation signal via the antenna to the tag unit 20. The transmitter 64 transmits the activation signal at a frequency to which the tag unit 20 is tuned. Thus, the tag unit 20 is able to receive the activation signal.

The operation of the luggage locking and locating device 18 will now be described with reference to the figures. In operation, the luggage locking and locating device 10 is prepared for use by connecting the locking device 38 of the tag unit 20 to an object such as a piece of luggage 14. The tag unit 20 is secured to the object and cannot be removed unless the correct combination is entered on the combination lock 40 of the tag unit 20. The luggage locking and locating device 18 is now ready for use.

At this point, the owner of the object may release the object for travel, e.g. to a baggage handler or ticket agent, so the object may be stored for travel, e.g. such as in a baggage compartment. Upon completing travel, the object will be transported to a central baggage pick up area where the owner may reclaim the object. The baggage pick up area is a crowded area in which passengers travelling with the owner go to retrieve their baggage. Furthermore, it is not uncommon that numerous pieces of baggage look similar or even identical. These factors as well as others make it difficult for a person to readily locate an object.

Upon entering the baggage pick up area and approaching the place where the baggage is most likely located, the owner will activate at least one of the sound button 44 and light button 46 on the remote unit 22. The activation of the sound button 44 and/or light button 46 causes the processor 60 of the remote unit 22 to generate an alarm activation signal 30. The alarm activation signal 30 is then transmitted by the transmitter 64 into the atmosphere at a frequency at which the tag unit 20 is tuned.

The activation signal 30 will be received by the receiver 54 of the tag unit 20 and provided to the processor 50 for analysis. The processor 50 analyzes the received activation signal 30 to determine which of the sound button 44 and light button 46 have been activated by the owner 24. Upon determining that the sound button 44 has been activated, the processor 50 activates the audible alarm 56 to generate the audible alarm signal 26. The audible alarm signal 26 may be a melodic tune preprogrammed by the owner 24 and easily recognizable to the ear of the owner. The audible alarm signal 26 is preferably able to be heard within a range of at least 30 feet from the tag unit 20. Upon determining that the light alarm button 46 has been activated, the processor 50 activates the visual alarm 58 to generate the visual alarm signal 28. The visual alarm signal 28 is preferably able to be seen within a range of at least 30 feet from the tag unit 20.

Upon generation of the audible alarm signal 26 and the visual alarm signal 28 the owner 24 is able to walk towards the sound of the tune played by the audible alarm signal 26 and/or towards the light emitted by the visual alarm signal 28 to locate the object to which the tag unit 20 is attached. If the owner is sight impaired, then the owner need only activate the audible alarm signal 26 and walk towards the sound generated by the signal. If the owner is hearing impaired, then the owner need only activate the visual alarm signal 28 and walk towards the light generated by the signal. Upon reaching the object, the owner can then deactivate the tag unit 20 and thus turn off the audible and/or visual alarm signals.

From the above description it can be seen that the luggage locking and locating device of the present invention is able to overcome the shortcomings of prior art devices by providing a luggage locking and locating device which is able to aid a person in locating an object such as luggage in a crowded area by providing an audible alarm signal for sight impaired users and provide a visual indication signal for hearing impaired users and thus also minimize the possibility of having luggage stolen or taken by a person other than the owner. The luggage locking and locating device includes a remotely activated tag unit including an audible alarm and visual alarm to signal the owner as to the location of the object and a remote control unit for remotely activating the audible and visual alarms. The luggage locking and locating device includes a user friendly device for locking the tag unit to an object and a tag for placement of information about the owner such as name, address and telephone number on the tag unit for aiding the owner in identifying the object. The visual signal is able to be viewed and the audible alarm, when activated, is able to be heard a minimum of thirty feet from the device. The audible alarm may generate a melodical tune which can be readily recognized by the owner. The luggage locking and locating device may also include logos as desired by the user to personalize the device. Furthermore, the luggage locking and locating device of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A luggage locking and locating device for aiding a user in finding luggage, said locating device comprising:

a) a remote unit retained by the user, said remote unit including:

i) a first processor for selectively generating a visual or audible alarm activation signal;

ii) a transmitter connected to said first processor for transmitting the selected alarm activation signal; and iii) means comprising a sound activation button and a light activation button for manually activating said first processor to select the alarm activation signal; and b) a tag unit releasable secured to luggage, said tag unit including:

i) a cylindrical section having a lock for releasably securing said tag unit to said luggage, said cylindrical portion of said tag unit containing a speaker for issuing an audible alarm and light emitters on opposite sides of said cylindrical section for issuing a visual alarm;

ii) a flat tag section extending from said cylindrical section displaying identification information regarding the user and a removable layer for covering said identification information;

iii) said cylindrical section also containing a second processor and a receiver for receiving said alarm activation signal transmitted by said remote unit, wherein upon receipt of the selected alarm activation signal said second processor activates said speaker or light emitter to aid the user in locating said luggage.

2. The luggage locking and locating device as recited in claim 1, wherein said means for releasably securing is a combination lock.

3. The luggage locking and locating device as recited in claim 2, wherein light issued by said light emitters is visible at a distance of at least 30 feet.

4. The luggage locking and locating device as recited in claim 3, wherein said speaker is able to be heard at a distance of at least 30 feet from said tag unit.

5. The luggage locking and locating device as recited in claim 4, wherein said audible signal is a melodic tune.

* * * * *